US006293103B1

(12) United States Patent
Gladden

(10) Patent No.: US 6,293,103 B1
(45) Date of Patent: Sep. 25, 2001

(54) TURBOCHARGER SYSTEM TO INHIBIT REDUCED PRESSURE IN INTAKE MANIFOLD

(75) Inventor: John R. Gladden, Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/666,634

(22) Filed: Sep. 21, 2000

(51) Int. Cl.[7] ..... F02B 33/44

(52) U.S. Cl. ..... 60/612; 60/602; 60/605.1; 416/198 A; 415/1; 415/11

(58) Field of Search ..... 60/611, 612, 602, 60/605.1; 417/19; 416/198 A; 415/26, 44, 1, 11

(56) References Cited

U.S. PATENT DOCUMENTS

| | | | | |
|---|---|---|---|---|
| 1,213,889 | * | 1/1917 | Lawaczeck | 415/199.3 |
| 2,189,106 | * | 2/1940 | Garve et al. | 60/612 |
| 2,216,074 | * | 9/1940 | Garve et al. | 60/612 |
| 3,941,506 | * | 3/1976 | Robbs et al. | 416/198 A |
| 4,418,537 | * | 12/1983 | Iwamoto | 60/611 |
| 4,571,151 | * | 2/1986 | Paul | 415/1 |
| 4,689,960 | * | 9/1987 | Schroder et al. | 60/607 |
| 4,807,150 | * | 2/1989 | Hobbs | 415/11 |

* cited by examiner

*Primary Examiner*—Thomas Denion
*Assistant Examiner*—Thai-Ba Trieu
(74) *Attorney, Agent, or Firm*—Todd T. Taylor

(57) ABSTRACT

An internal combustion engine is provided with at least one intake manifold and a turbocharger. The turbocharger includes a rotatable shaft; a turbine having a turbine wheel carried by the shaft; and a multi-stage compressor. The multi-stage compressor includes a first compressor wheel carried by the shaft, an axially extending first inlet associated with the first compressor wheel, a radially extending first outlet associated with the first compressor wheel, a second compressor wheel carried by the shaft, an axially extending second inlet associated with the second compressor wheel, a radially extending second outlet associated with the second compressor wheel, and an interstage duct fluidly interconnecting in series the first outlet associated with the first compressor wheel with the second inlet associated with the second compressor wheel. The second outlet is fluidly coupled with the intake manifold. One or more valves are each fluidly coupled with an ambient environment and the interstage duct or intake manifold. Each valve is adapted to open when a pressure of the ambient environment is less than a pressure within the interstage duct or intake manifold.

22 Claims, 1 Drawing Sheet

TURBOCHARGER SYSTEM TO INHIBIT REDUCED PRESSURE IN INTAKE MANIFOLD

TECHNICAL FIELD

The present invention relates to a turbocharger system for use in an internal combustion engine, and, more particularly, to a turbocharger system with a multi-stage compressor.

BACKGROUND ART

An internal combustion engine may include one or more turbochargers for compressing a fluid which is supplied to one or more combustion chambers within corresponding combustion cylinders. Each turbocharger typically includes a turbine driven by exhaust gases of the engine and a compressor which is driven by the turbine. The compressor receives the fluid to be compressed and supplies the fluid to the combustion chamber. The fluid which is compressed by the compressor may be in the form of combustion air or a fuel and air mixture.

During low load conditions such as an idle condition in a diesel engine, the exhaust gases do not drive the turbocharger at a rotational speed which is sufficient to significantly compress the combustion air. In fact, under low load conditions the turbocharger can act as a restriction to the combustion air which is transported to the intake manifold. It is thus possible that under certain low load conditions the turbocharger may in fact impede the efficient operation of the internal combustion engine.

It is also known that a turbocharger in an internal combustion engine may undergo a surge condition, during which the volumetric flow rate to the compressor is too low and the pressure ratio is too high. Thus, the flow can no longer adhere to the suction side of the blades of the compressor wheels and the discharge process is interrupted. The air flow through the compressor is reversed until a stable pressure ratio with positive volumetric flow rate is reached, the pressure builds up again and the cycle repeats. It is known to sense the impending or actual occurrence of a surge condition associated with a compressor and bleed off compressed gas within the compressor to alleviate the surge condition. It is also known to bleed off compressed gas within the compressor upon the occurrence of other operating conditions, such as a high pressure condition, etc. An example of a compressor in a turbocharger which bleeds off high pressure gas from the compressor is disclosed in U.S. Pat. No. 3,044,683 (Woollenweber).

The present invention is directed to overcoming one or more of the problems as set forth above.

DISCLOSURE OF THE INVENTION

In one aspect of the invention, a turbocharger system for an internal combustion engine is provided with a turbocharger including a rotatable shaft and a multi-stage compressor. The multi-stage compressor includes a first compressor wheel carried by the shaft, an axially extending first inlet associated with the first compressor wheel, a radially extending first outlet associated with the first compressor wheel, a second compressor wheel carried by the shaft, a second inlet associated with the second compressor wheel, a radially extending second outlet associated with the second compressor wheel, and an interstage duct fluidly interconnecting in series the first outlet associated with the first compressor wheel with the second inlet associated with the second compressor wheel. One or more sensors are each configured to sense a pressure associated with the multi-stage compressor and provide an output signal. A valve is fluidly coupled with the interstage duct and an ambient environment. A controller is coupled with each sensor and a valve. The controller controls operation of the valve dependent upon at least one output signal.

In another aspect of the invention, an internal combustion engine is provided with at least one intake manifold and a turbocharger. The turbocharger includes a rotatable shaft; a turbine having a turbine wheel carried by the shaft; and a multi-stage compressor. The multi-stage compressor includes a first compressor wheel carried by the shaft, an axially extending first inlet associated with the first compressor wheel, a radially extending first outlet associated with the first compressor wheel, a second compressor wheel carried by the shaft, a second inlet associated with the second compressor wheel, a radially extending second outlet associated with the second compressor wheel, and an interstage duct fluidly interconnecting in series the first outlet associated with the first compressor wheel with the second inlet associated with the second compressor wheel. The second outlet is fluidly coupled with the intake manifold. One or more valves are each fluidly coupled with an ambient environment and the interstage duct or intake manifold. Each valve is adapted to open when a pressure of the ambient environment is less than a pressure within the interstage duct or intake manifold.

In yet another aspect of the invention, a method of operating a turbocharger system in an internal combustion engine is provided with the steps of: providing at least one intake manifold; providing a turbocharger including: a rotatable shaft; and a multi-stage compressor including a first compressor wheel carried by the shaft, an axially extending first inlet associated with the first compressor wheel, a radially extending first outlet associated with the first compressor wheel, a second compressor wheel carried by the shaft, an axially extending second inlet associated with the second compressor wheel, a radially extending second outlet associated with the second compressor wheel, and an interstage duct fluidly interconnecting in series the first outlet associated with the first compressor wheel with the second inlet associated with the second compressor wheel, the second outlet being fluidly coupled with the intake manifold; fluidly coupling at least one valve between an ambient environment and one of the interstage duct and the intake manifold; and opening at least one valve when a pressure within the intake manifold is less than a pressure of the ambient environment.

BRIEF DESCRIPTION OF THE DRAWINGS

The sole FIGURE is a partially sectioned, partially schematic view of an internal combustion engine including an embodiment of a turbocharger system of the present invention.

BEST MODE FOR CARRYING OUT THE INVENTION

Figure 1:
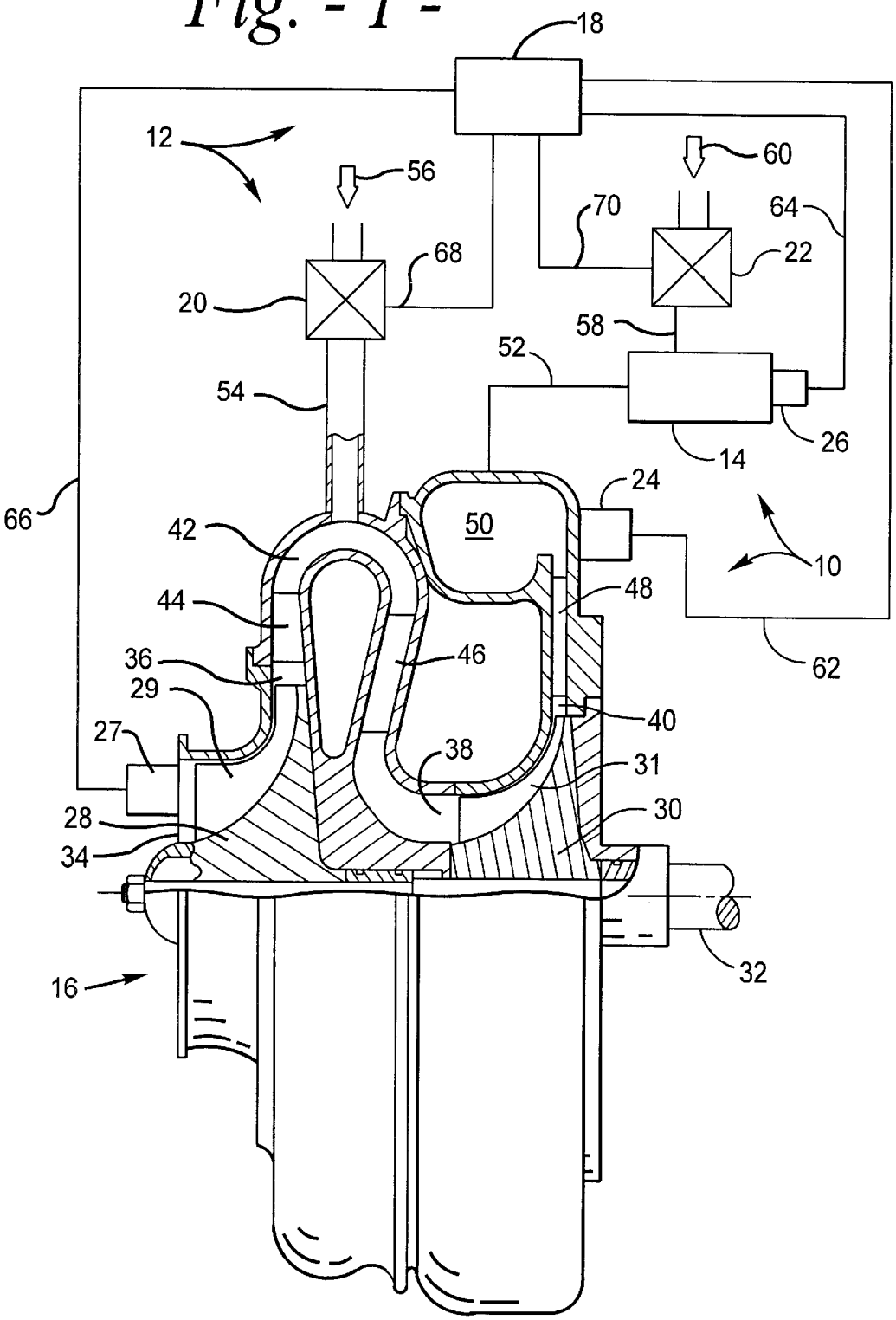

Referring now to the drawing, there is shown an internal combustion engine 10 including an embodiment of a turbocharger system 12 of the present invention. Internal combustion engine 10 includes an engine block (not shown) carrying a plurality of combustion cylinders (not shown). An intake manifold 14 is fluidly coupled with the combustion cylinders and provides combustion air or a fuel and air mixture to the combustion cylinders. Intake manifold 14 is constructed as a single intake manifold in the embodiment shown, but may also be constructed as a multi-part manifold with each part providing combustion air to a different subset of the combustion cylinders.

Turbocharger system 12 includes a multi-stage compressor 16, a controller 18, one or more valves 20 and 22, and one or more sensors 24 and 26.

Multi-stage compressor 16 includes a first compressor wheel 28 having a plurality of blades 29 and a second compressor wheel 30 having a plurality of blades 31, each carried by a common shaft 32. An axially extending first inlet 34 and a radially extending first outlet 36 are associated with first compressor wheel 28; and an axially extending second inlet 38 and a radially extending second outlet 40 are associated with second compressor wheel 30. An interstage duct 42 fluidly interconnects first outlet 36 in series with second inlet 38. A plurality of diffuser vanes 44 are positioned at the downstream side of first outlet 36 in fluid communication with interstage duct 42. Diffuser vanes 44 cause the air flow exiting from first outlet 36 to decrease in velocity and increase in static pressure. A plurality of deswirler vanes 46 positioned within interstage duct 42 upstream from second inlet 38 reduce the swirling of the air flowing through interstage duct 42, and direct the air into second inlet 38. A plurality of diffuser vanes 48 are positioned downstream from second outlet 40 associated with second compressor wheel 30. Diffuser vanes 48 function similarly to diffuser vanes 44, and thereby cause a decreased velocity and increased static pressure in the air flow exiting from second outlet 40. A volute 50 on the downstream side of diffuser vanes 48 discharges the compressed air to intake manifold 14 via fluid line 52. Valve 20 may be configured to simply provide an open passageway between the ambient environment and interstage duct 42 or may be configured as a one-way valve to only allow fluid flow from the ambient environment into interstage duct 42.

Valve 20 is fluidly interconnected with interstage duct 42 via fluid line 54. Valve 20 has an inlet which receives ambient air, as indicated by arrow 56. Valve 20 is electrically coupled with controller 18 and is selectively actuated by controller 18, as will be described in more detail hereinafter.

Valve 22 is fluidly coupled with intake manifold 14 via fluid line 58. Valve 22 has an inlet which receives ambient air, as indicated by directional arrow 60. Valve 22 is electrically coupled with controller 18 and is selectively controlled by controller 18, as will be described in more detail hereinafter. Valve 22 may be configured to simply provide an open passageway between the ambient environment and the interior of intake manifold 14, or may be configured as a one-way valve to only allow flow from the ambient environment into intake manifold 14.

Sensors 24 and 26 are each electrically coupled with controller 18 and provide one or more output signals to controller 18. Regardless of the specific configuration of the particular sensor(s) utilized, an output signal is intended to be provided which is used to determine whether the pressure within intake manifold 14 is less than the ambient pressure. Sensor 24 senses a pressure at second collector 50. Sensor 26 senses a pressure within intake manifold 14. Alternatively, since second outlet 40 is fluidly coupled with intake manifold 14 via fluid line 52, the pressure sensed by sensor 24 can also be used to infer the pressure within intake manifold 14.

Other sensor configurations are also possible. For example, the fuel consumption rate of internal combustion engine 10 may be used to infer that the engine is at an idle or low load condition, thereby inferring that multi-stage compressor 16 is not providing substantial compression to the combustion air. Alternatively, the rotational speed of shaft 32 may be directly sensed. Moreover, sensors 24 and 27 may each provide an output signal to controller 18, which in turn determines a pressure drop across multi-stage compressor 16 from the output signals. Thus, regardless of the output signal received, controller 18 determines that either multi-stage compressor 16 is not operating efficiently, or is in fact impeding the flow of combustion air into intake manifold 14, and thereby independently or dependently actuates valves 20 and/or 22.

Industrial Applicability

During use, exhaust gas from the exhaust manifold (not shown) drives the turbine wheel (not shown) carried by shaft 32. Shaft 32 in turn rotationally drives first compressor wheel 28 and second compressor wheel 30. Combustion air enters multi-stage compressor 16 at first inlet 34. Blades 29 of first compressor wheel 28 accelerate the flow to first outlet 36. The accelerated air impinges upon diffuser vanes 44, resulting in a decreased velocity and increased static pressure. Deswirler vanes 46 reduce the swirling action of the air flowing through interstage duct 42 and direct the air into second inlet 38 associated with second compressor wheel 30. Blades 31 of second compressor wheel 30 accelerate the air to second outlet 40 where the high velocity air impinges upon diffuser vanes 48, resulting in an increased static pressure. The compressed air then flows into volute 50. From volute 50, the compressed air is transported to intake manifold 14.

During engine operating conditions other than at low load or engine idle conditions, multistage compressor 16 provides a positive pressure ratio resulting in compressed air being supplied to intake manifold 14 at a pressure above the ambient pressure. However, at certain low load or engine idle conditions, turbocharger 16 may operate inefficiently or in fact act as a restriction to the combustion air transported to intake manifold 14. Sensors 24, 26, 27 and/or other suitable sensors as described above are utilized to determine whether multi-stage compressor should in essence be bypassed to provide ambient combustion air to intake manifold 14. For example, sensors 24, 26 and 27 may each provide one or more output signals via lines 62, 64 and 66, respectively, to controller 18. Controller 18 receives the output signals from one or more sensors and determines whether a selected valve 20 and/or 22 should be opened by outputting a control signal via line 68 or 70, respectively. When valve 20 and/or 22 is opened, ambient air flows into interstage duct 42 or directly into intake manifold 14, as indicated by arrows 56 and 60, respectively.

In the embodiment shown in the drawing, valve 20 is disposed in fluid communication with interstage duct 42 to in essence bypass first compressor wheel 28 of multi-stage compressor 16. This configuration has been found to alleviate pressure drop across multi-stage compressor 16. It will also be appreciated that valve 20 may be disposed in fluid communication with volute 50, thereby providing combustion air at ambient pressure to intake manifold 14 via fluid line 52.

The turbocharger system of the present invention allows a multi-stage compressor to efficiently operate at conditions other than a low load or idle condition when substantial compressing of the combustion air occurs. On the other hand, upon sensing of a low load or engine idle condition, at least a part or all of multi-stage compressor 16 is bypassed by opening a valve allowing ambient air to be drawn into the flow path of the combustion air. This ensures that a negative pressure drop does not occur across the multi-stage compressor, and also ensures that the combustion air is provided at least at ambient pressure to intake manifold 14.

Other aspects, objects and advantages of this invention can be obtained from a study of the drawings, the disclosure and the appended claims.

What is claimed is:

1. A turbocharger system for an internal combustion engine, comprising:

a turbocharger including:

a rotatable shaft;

a multi-stage compressor including a first compressor wheel carried by said shaft, an axially extending first inlet associated with said first compressor wheel, a radially extending first outlet associated with said first compressor wheel, a second compressor wheel carried by said shaft, a second inlet associated with said second compressor wheel, a radially extending second outlet associated with said second compressor wheel, and an interstage duct fluidly interconnecting in series said first outlet associated with said first compressor wheel with said second inlet associated with said second compressor wheel;

at least one sensor, each said sensor configured to sense a pressure associated with said multi-stage compressor and provide an output signal;

a valve fluidly coupled with said interstage duct and an ambient environment; and a controller coupled with each said sensor and said valve, said controller controlling operation of said valve dependent upon at least one said output signal.

2. The turbocharger system of claim 1, each said sensor being configured to sense one of:

a pressure associated with said first outlet;

a pressure associated with said second outlet;

a pressure within said interstage duct; and a pressure difference between said second outlet and said first inlet.

3. The turbocharger system of claim 2, said at least one sensor including a plurality of sensors.

4. The turbocharger system of claim 1, said at least one sensor including a plurality of sensors, said controller receiving an output signal from at least two of said sensors and determining a pressure drop across said multi-stage compressor.

5. The turbocharger system of claim 4, said controller opening said valve upon said determining of said pressure drop.

6. The turbocharger system of claim 1, said valve being a one-way valve allowing flow of air from the ambient environment into said interstage duct.

7. An internal combustion engine, comprising:

at least one intake manifold;

a turbocharger including:

a rotatable shaft; and a multi-stage compressor including a first compressor wheel carried by said shaft, an axially extending first inlet associated with said first compressor wheel, a radially extending first outlet associated with said first compressor wheel, a second compressor wheel carried by said shaft, a second inlet associated with said second compressor wheel, a radially extending second outlet associated with said second compressor wheel, and an interstage duct fluidly interconnecting in series said first outlet associated with said first compressor wheel with said second inlet associated with said second compressor wheel, said second outlet being fluidly coupled with said intake manifold; and at least one valve, each said valve being fluidly coupled with an ambient environment and one of said interstage duct and said intake manifold, each said valve being adapted to open when a pressure of the ambient environment is more than a pressure within said one of said interstage duct and said intake manifold.

8. The internal combustion engine of claim 7, including at least one sensor, each said sensor configured to sense a pressure associated with at least one of said multi-stage compressor and said intake manifold, each said sensor providing an output signal; and a controller coupled with each said sensor and each said valve, said controller controlling operation of each said valve dependent upon at least one said output signal.

9. The internal combustion engine of claim 8, each said sensor being configured to sense one of:

a pressure associated with said first outlet;

a pressure associated with said second outlet;

a pressure within said interstage duct;

a pressure difference between said second outlet and said first inlet; and a pressure within said intake manifold.

10. The internal combustion engine of claim 9, said at least one sensor including a plurality of sensors.

11. The internal combustion engine of claim 8, said at least one sensor including a plurality of sensors, at least two of said sensors associated with said multi-stage compressor, said controller receiving an output signal from at least two of said sensors associated with said multi-stage compressor and determining a pressure drop across said multi-stage compressor.

12. The internal combustion engine of claim 11, said controller opening at least one said valve upon said determining of said pressure drop.

13. The internal combustion engine of claim 8, said controller independently controlling operation of each said valve dependent upon at least one said output signal.

14. The internal combustion engine of claim 7, one said valve being fluidly coupled with said interstage duct.

15. The internal combustion engine of claim 7, one said valve being fluidly coupled with said intake manifold.

16. A method of operating a turbocharger system in an internal combustion engine, comprising the steps of:

providing at least one intake manifold;

providing a turbocharger including:

a rotatable shaft; and a multi-stage compressor including a first compressor wheel carried by said shaft, an axially extending first inlet associated with said first compressor wheel, a radially extending first outlet associated with said first compressor wheel, a second compressor wheel carried by said shaft, a second inlet associated with said second compressor wheel, a radially extending second outlet associated with said second compressor wheel, and an interstage duct fluidly interconnecting in series said first outlet associated with said first compressor wheel with said second inlet associated with said second compressor wheel, said second outlet being fluidly coupled with said intake manifold;

fluidly coupling at least one valve between an ambient environment and one of said interstage duct and said intake manifold; and opening at least one said valve when a pressure within said intake manifold is less than a pressure of said ambient environment.

17. The method of claim 16, including the steps of:

sensing a pressure associated with at least one of said multi-stage compressor and said intake manifold using at least one said sensor; and providing an output signal from each said sensor corresponding to said respective sensed pressure;

said opening step including controlling operation of each said valve using a controller coupled with each said sensor and each said valve, dependent upon at least one said output signal.

18. The method of claim 17, wherein said sensing step includes sensing at least one of:

a pressure associated with said first outlet;

a pressure associated with said second outlet;

a pressure within said interstage duct;

a pressure difference between said second outlet and said first inlet; and a pressure within said intake manifold.

19. The method of claim 16, said at least one sensor including a plurality of sensors, at least two of said sensors associated with said multi-stage compressor, and including the steps of:

receiving an output signal from at least two of said sensors at said controller; and determining a pressure drop across said multi-stage compressor.

20. The method of claim 19, including the step of opening at least one said valve using said controller upon said determining of said pressure drop.

21. The method of claim 16, including the step of fluidly coupling one said valve with said interstage duct.

22. The method of claim 16, including the step of fluidly coupling one said valve with said intake manifold.

* * * * *